US007854126B2

(12) United States Patent
Hernandez et al.

(10) Patent No.: US 7,854,126 B2
(45) Date of Patent: Dec. 21, 2010

(54) ANNULAR COMBUSTION CHAMBER WITH A REMOVABLE END WALL

(75) Inventors: Didier Hippolyte Hernandez, Quiers (FR); David Locatelli, Gex (FR)

(73) Assignee: SNECMA, Paris (FR)

( * ) Notice: Subject to any disclaimer, the term of this patent is extended or adjusted under 35 U.S.C. 154(b) by 973 days.

(21) Appl. No.: 11/677,749

(22) Filed: Feb. 22, 2007

(65) Prior Publication Data

US 2007/0200012 A1 Aug. 30, 2007

(30) Foreign Application Priority Data

Feb. 27, 2006 (FR) ..... 06 50664

(51) Int. Cl.
*F23R 3/50* (2006.01)
*F23R 3/60* (2006.01)

(52) U.S. Cl. ..... 60/798; 60/804; 60/752

(58) Field of Classification Search ..... 60/798, 60/800, 804, 752
See application file for complete search history.

(56) References Cited

U.S. PATENT DOCUMENTS

| | | | | |
|---|---|---|---|---|
| 5,609,031 | A * | 3/1997 | Jones | 60/800 |
| 6,314,739 | B1 * | 11/2001 | Howell et al. | 60/748 |
| 7,509,813 | B2 * | 3/2009 | Stastny | 60/804 |
| 2004/0124282 | A1 | 7/2004 | Mansour et al. | |

FOREIGN PATENT DOCUMENTS

| | | | |
|---|---|---|---|
| EP | 1 312 865 | A1 | 5/2003 |
| GB | 2011546 | * | 7/1979 |
| GB | 2 297 829 | A | 8/1996 |

* cited by examiner

*Primary Examiner*—Ted Kim
(74) *Attorney, Agent, or Firm*—Oblon, Spivak, McClelland, Maier & Neustadt, L.L.P.

(57) ABSTRACT

A one-piece combustion chamber having an end wall subdivided into sectors. The combustion chamber comprises a chamber end wall interconnecting the inner and outer walls, and it includes windows closed by removable walls, each carrying a plurality of injector systems.

7 Claims, 2 Drawing Sheets

ANNULAR COMBUSTION CHAMBER WITH A REMOVABLE END WALL

The invention relates to the field of turbomachines. It relates more precisely to an annular combustion chamber, and in particular to a so-called one-piece combustion chamber in which the pieces that make it up are welded together, preferably butt welded. The invention relates more particularly to an improvement giving better access to the internal zones of the combustion area that might need repairing.

BACKGROUND OF THE INVENTION

With combustion chambers that are assembled using bolts, the presence of bolts outside the chamber can lead to significant head losses and disturbances in the flow of air going round said chamber. In addition, bolting cylindrical pieces raises problems of docking and can lead to deformation. This leads to significant leaks at the end wall of the chamber. In contrast, when it comes to maintenance, such combustion chambers present the advantage of being capable of being disassembled.

With a one-piece chamber, the outer and inner walls are welded together with the chamber end wall, preferably being butt welded. That type of assembly eliminates all of the above-mentioned problems. However accessibility for maintenance purposes raises a problem.

OBJECT AND SUMMARY OF THE INVENTION

The invention provides a solution to that problem.

More particularly, the invention provides an annular combustion chamber comprising an outer wall, an inner wall, and a chamber end wall interconnecting the outer and inner walls, wherein said chamber end wall includes windows distributed circumferentially and closed by removable walls, and wherein each removable wall constitutes a support for a plurality of injector systems.

In this way, the outer and inner walls and also the chamber end wall can be welded together permanently, advantageously by means of butt welding.

The invention facilitates the operating of brazing the chamber end wall, sectorization reduces the size of the part for the operations of removal, brazing, and baking.

The removable walls are preferably themselves welded to the chamber end wall so that the windows are completely closed. However the welding is performed in such a manner as to be easily eliminated by grinding, thus making such a removable wall carrying a certain number of injector systems easy to remove. For example, three injector systems can be grouped together on a single removable wall.

During maintenance operations, removing one or more removable walls gives access to zones for repair, from the upstream end, while benefiting from the advantages of one-piece chamber technology.

This also serves to eliminate leaks at the chamber end wall and head losses in the stream of air bypassing the combustion chamber.

It is also possible to take action locally and remove only one or a few of the above-mentioned removable walls.

BRIEF DESCRIPTION OF THE DRAWINGS

The invention can be better understood and other advantages thereof appear more clearly in the light of the following description of a one-piece type combustion chamber in accordance with the invention and described solely by way of example and with reference to the accompanying drawings, in which.

MORE DETAILED DESCRIPTION

Figure 1:
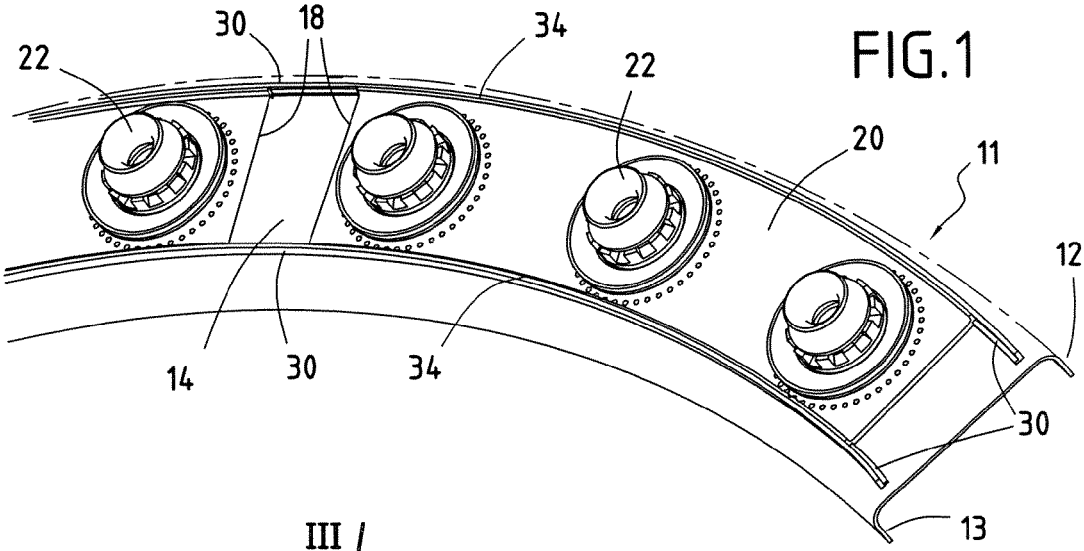
FIG. 1 is a fragmentary perspective view from behind of the combustion chamber when assembled.
Figure 2:
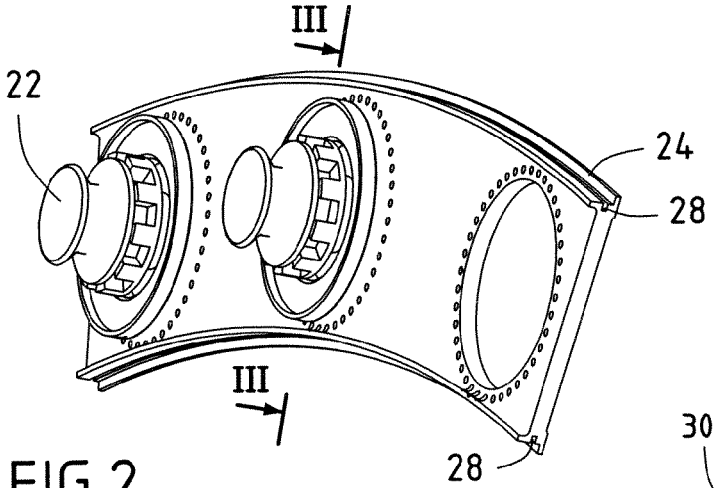
FIG. 2 is a perspective view of a removable plate for the chamber end wall.
Figure 3:
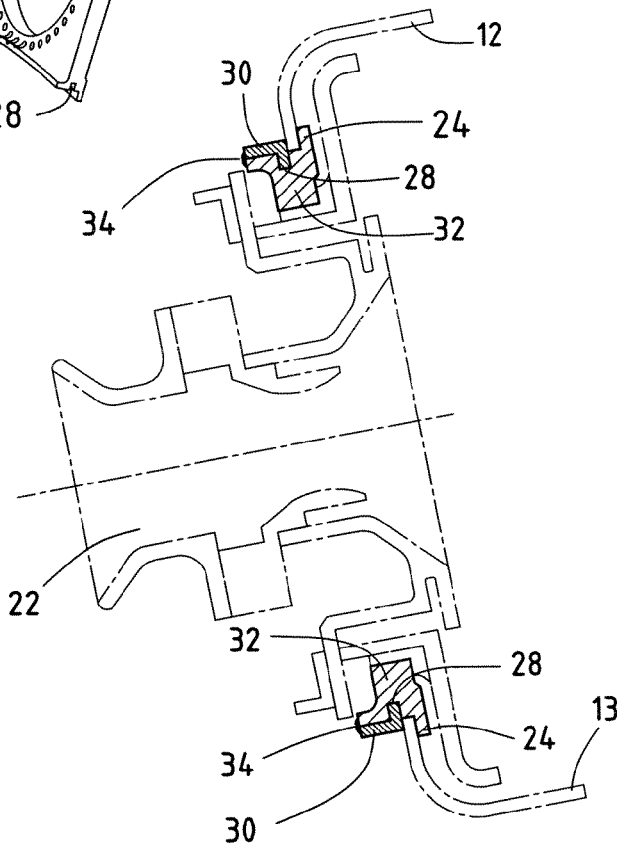
FIG. 3 is a section on III-III of FIG. 2.

The drawings show a portion of a combustion chamber 11, of which there can be seen in particular an annular outer wall 12, an annular inner wall 13, and a chamber end wall 14 interconnecting the outer and inner walls.

Advantageously, said outer and inner walls are respectively welded to the outer and inner edges of the chamber end wall.

According to an important characteristic of the invention, the chamber end wall has windows 18 that are distributed circumferentially, and these windows are closed by removable walls 20. Each removable wall, in the form of an annular sector, constitutes a support for a plurality of injector systems 22. In the example, each removable wall carries three injector systems.

Each removable wall 20 is itself welded to the chamber end wall, however the welding can easily be eliminated by grinding.

To do this, each removable wall has a peripheral shoulder defining an internal bearing margin 24 that comes into contact with the inside face of the chamber end wall. On assembly, the removable wall can easily be engaged in the window and then pivoted so as to press against the inside of the chamber end wall.

Furthermore, on at least two of its side faces, the removable wall has grooves 28 that are parallel to the bearing margin. In the example, such grooves are formed along the curved edges of the removable wall. The distance between the edge of such a groove and said adjacent bearing margin is equal to the thickness of the chamber end wall 14.

Stop clips 30 are engaged in the grooves 28 to define outer bearing surfaces that come into contact with the outside face of the chamber end wall. In the example shown, such a stop clip 30 has an L-shaped profile. One limb of the clip is thus engaged in the groove 28 and the end of the other limb is welded to the periphery of the removable wall. More precisely, in the example, the periphery of said removable wall presents ribs 32, and the main limb of the L-shaped clip 30 bears parallel to the rib, and outside it. The end of the other limb of each clip is welded to the top of such a rib by a bead of welding 34.

Naturally, the same arrangement of a welded stop clip could be provided along the radial edges of each removable wall.

Figure 4:
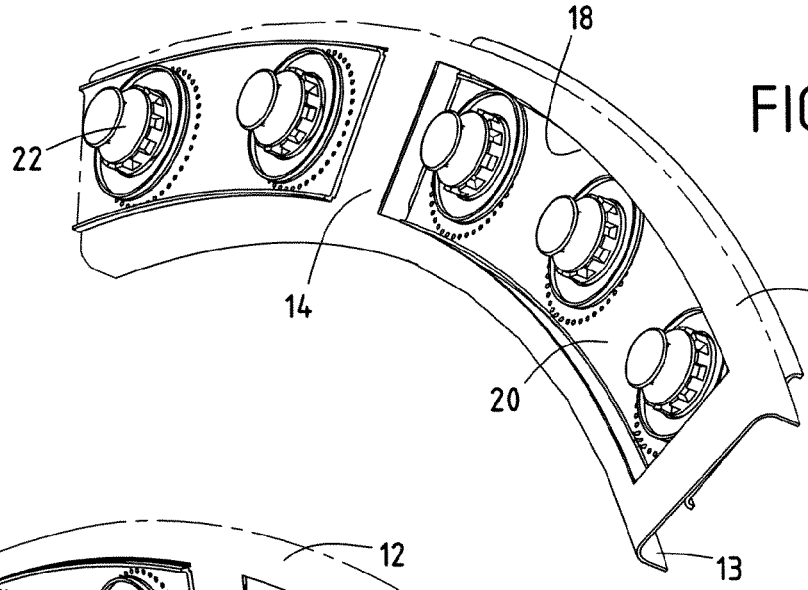
FIGS. 4 to 6 are fragmentary perspective views showing a removable wall being removed during a maintenance operation.
Figure 5:
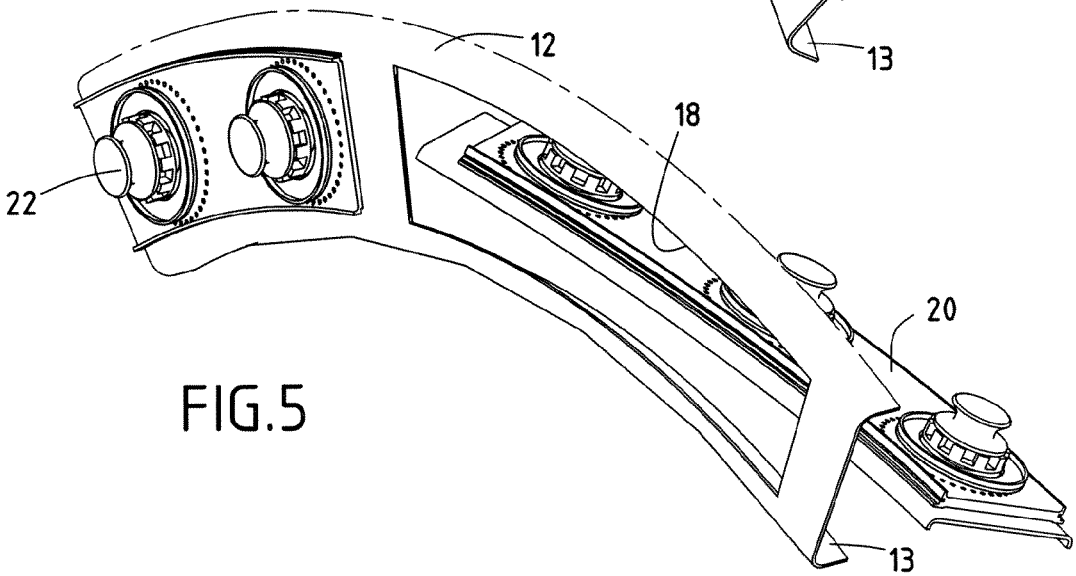
Figure 6:
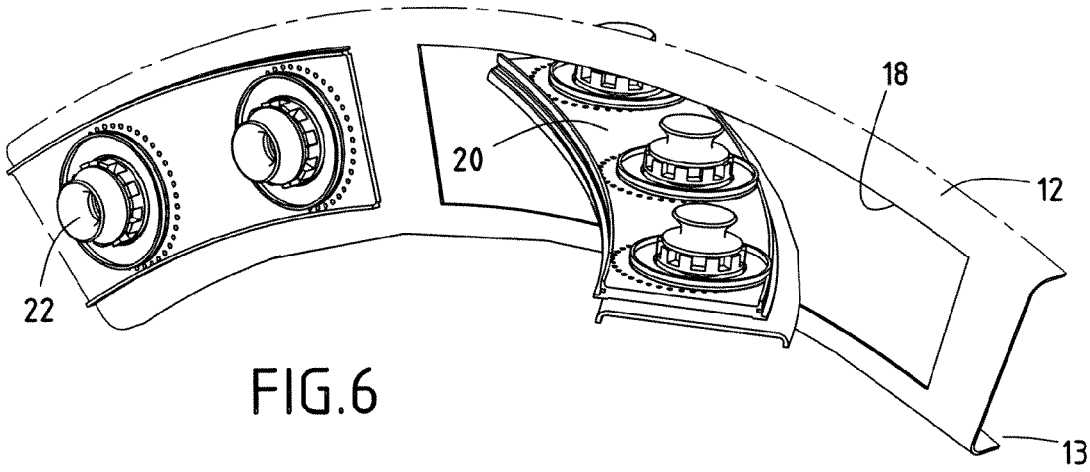

A removable wall in accordance with the above description can easily be removed during a maintenance operation by proceeding as shown in FIGS. 4 to 6. The first step is to grind away the two beads of welding 34, thus enabling the removable wall (carrying the three injector systems) to be separated from the end wall of the chamber by pushing it into the combustion area (FIG. 4). Thereafter, the removable wall is pivoted in the combustion area (FIG. 5), and finally it is extracted via one of its ends, disengaging it from the window. The window is large enough radially to allow the removable wall carrying its injector system 22 to pass through without it being necessary to dismantle the injector systems.

What is claimed is:

1. An annular combustion chamber comprising an outer wall, an inner wall, and a chamber end wall interconnecting the outer and inner walls, wherein said chamber end wall includes windows distributed circumferentially and closed by removable walls, and wherein each removable wall constitutes a support for a plurality of injector systems, wherein each removable wall includes a peripheral shoulder defining an internal bearing margin that comes into contact with the inside face of the chamber end wall; and wherein said removable wall includes, on its edge faces, grooves parallel to said bearing margin, and wherein stop clips are engaged in said grooves to define external bearing surfaces that come into contact with the outside face of said chamber end wall.

2. A combustion chamber according to claim 1, wherein the outer and inner walls and the chamber end wall are welded together.

3. A combustion chamber according to claim 1, wherein each removable wall carries three injector systems.

4. A combustion chamber according to claim 1, wherein said removable wall includes, on its edge faces, grooves parallel to said bearing margin, and wherein stop clips are engaged in said grooves to define external bearing surfaces that come into contact with the outside face of said chamber end wall.

5. A combustion chamber according to claim 1, wherein such a stop clip has an L-shaped profile, one limb of said clip being engaged in an above-mentioned groove and the end of the other limb being welded to the periphery of said removable wall.

6. A combustion chamber according to claim 5, wherein the periphery of said removable wall presents ribs, and wherein said end of the other limb of each clip is welded to the top of such a rib.

7. A turbomachine including a combustion chamber according to claim 1.

* * * * *